US005127169A

United States Patent [19]

Ellingson

[11] Patent Number: 5,127,169

[45] Date of Patent: Jul. 7, 1992

[54] CLOTHES DRYER

[75] Inventor: David I. Ellingson, Newton, Iowa

[73] Assignee: Maytag Corporation, Newton, Iowa

[21] Appl. No.: 645,965

[22] Filed: Jan. 25, 1991

[51] Int. Cl.[5] ..... D06F 58/00

[52] U.S. Cl. ..... 34/133 F; 34/133 H; 34/133 G

[58] Field of Search ..... 34/130, 131, 132, 133 F, 34/133 G, 133 H, 133 R

[56] References Cited

U.S. PATENT DOCUMENTS

| | | | |
|---|---|---|---|
| 2,855,698 | 10/1958 | Hutt | 34/133 |
| 2,927,380 | 3/1960 | Olthuis | 34/133 |
| 2,936,527 | 5/1960 | Hutt | 34/133 |
| 3,321,846 | 5/1967 | Heinicke | 34/181 |
| 3,584,393 | 6/1971 | Menk | 34/133 |
| 3,696,521 | 10/1972 | Hubbard | 34/133 |
| 3,840,998 | 10/1974 | Marcussen | 34/133 |
| 4,007,546 | 2/1977 | Sauer | 34/133 |
| 4,430,809 | 2/1984 | Jackson et al. | 34/133 |
| 4,550,509 | 11/1985 | Murase | 34/133 |
| 4,669,200 | 6/1987 | Carr | 34/133 |
| 4,754,556 | 7/1988 | Carr | 34/133 |
| 4,817,298 | 4/1989 | Toma | 34/133 |

*Primary Examiner*—Henry A. Bennet
*Assistant Examiner*—Denise L. F. Gromada
*Attorney, Agent, or Firm*—R. L. Ward; A. P. Orsund

[57] ABSTRACT

A domestic clothes dryer construction which increases dryer capacity by allowing the length of the drum to be increased while keeping the cabinet size the same. In the present invention, the single rear cabinet panel is used as a drum support, and in so doing, eliminates the separate rear bulkhead structure attached to the rear panel of the dryer in present day dryers.

17 Claims, 6 Drawing Sheets

CLOTHES DRYER

This invention relates to a domestic clothes dryer for drying clothes in a horizontal drum that is rotatably mounted in a cabinet and includes means for introducing heated air into the drum for circulation and removal of moisture from the clothes.

BACKGROUND OF THE INVENTION

Clothes dryers in use today are generally constructed utilizing front and rear bulkheads for mounting the drum for rotation and for supporting certain related parts of the dryer. The bulkheads are enclosed on all sides by a cabinet fabricated to a rectangular figure approaching a cube. The air utilized in drying is inspirited into the lower portion of the dryer and circulated into the back via duct work then through the drum and exhausted at the front of the drum. Moisture laden air from the drum is discharged into duct work that usually exits at the rear wall of the dryer cabinet.

SUMMARY OF THE INVENTION

The dryer construction according to this invention enables a larger volume drying chamber by increasing the length of the cylinder wall drum while keeping the cabinet size the same.

In the dryer of this invention, the drum is rotatably supported and sealed on the single rear panel of the rectangular cabinet and on a front bulkhead. Accordingly, a separate rear bulkhead member of the dryer is eliminated.

It is therefore an object of the invention to provide a clothes dryer of given size cabinet having increased capacity for clothes drying. In the present invention, the single rear cabinet panel is utilized as a drum support, and in so doing does away with the separate rear bulkhead structure attached to the rear panel of the dryer in present day dryers.

A further object of the invention is to provide a clothes dryer that is economical to manufacture.

And a still further object of the invention is to provide a clothes dryer which is of simple construction for serviceability and decreased weight and cost.

Briefly, the instant invention achieves these objects in a clothes drying apparatus including a cabinet having side, bottom, top, rear and front panels. A bulkhead is located within the cabinet adjacent the front panel. A cylinder wall with a generally horizontal axis has front and rear annular seal surfaces juxtaposed to the bulkhead and the rear panel respectively. The rear cabinet panel has a circular portion generally corresponding to and aligned with the rear annular seal surface and the bulkhead has a circular portion generally corresponding to and aligned with the front annular seal surface of the cylinder wall. The cylinder wall, rear panel circular portion and the bulkhead circular portion define a clothes drying chamber First and second seals engage the circular portions of the rear panel and the bulkhead and the respective generally mating annular seal surfaces at the rear and front of the cylinder wall. The cylinder wall is supported for rotation about its horizontal axis and a drive mechanism is provided for rotating the cylinder wall. Apparatus is also provided for introducing heated air into and removing moisture laden air from the drying chamber.

Other advantages and features of the invention hall become readily apparent to those skilled in the art upon reference to the accompanying drawings and the description of a preferred embodiment hereinafter set forth.

DESCRIPTION OF A PREFERRED EMBODIMENT

Figure 1:
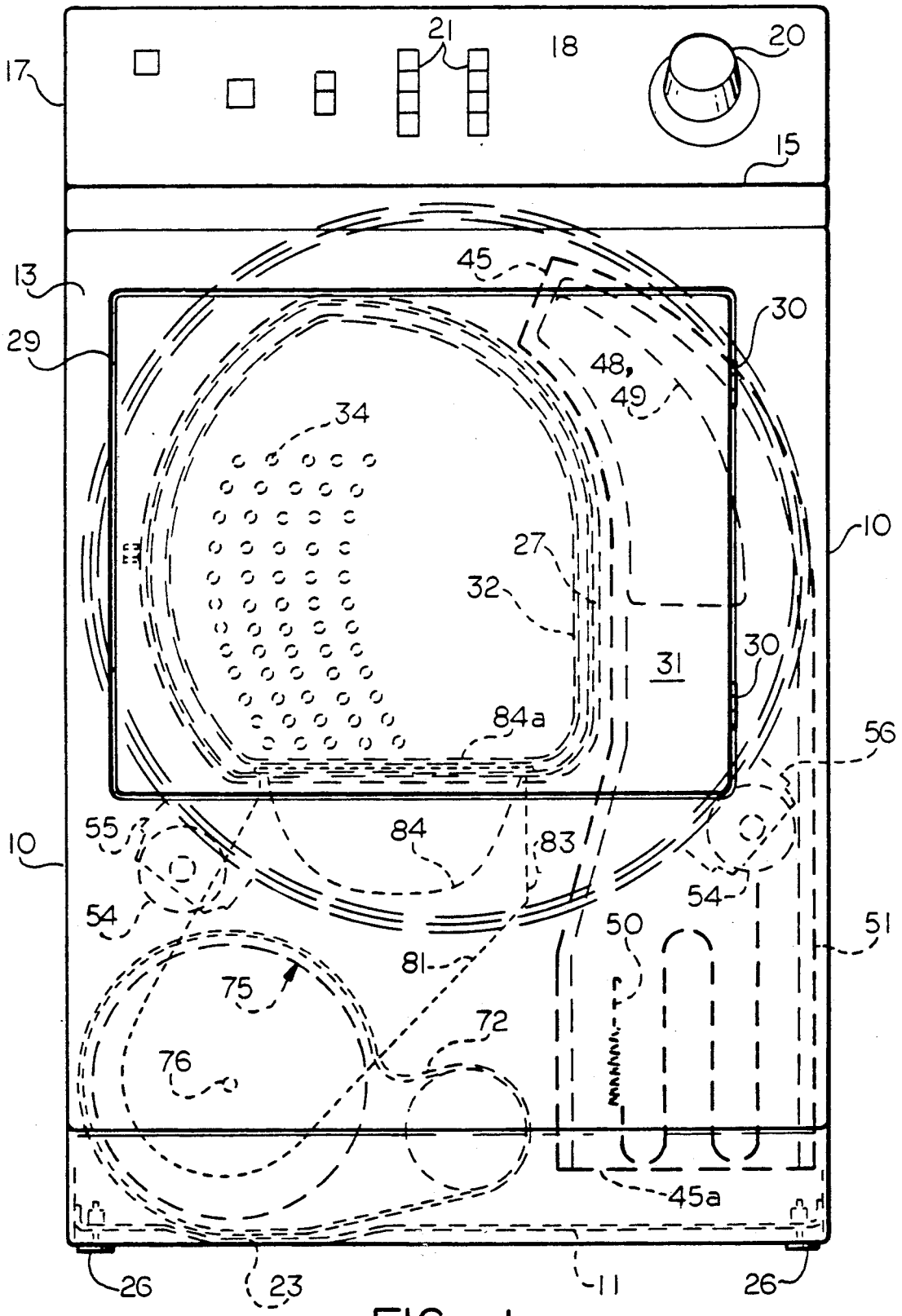
FIG. 1 is a front elevational view of the clothes dryer of the present invention.
Figure 2:
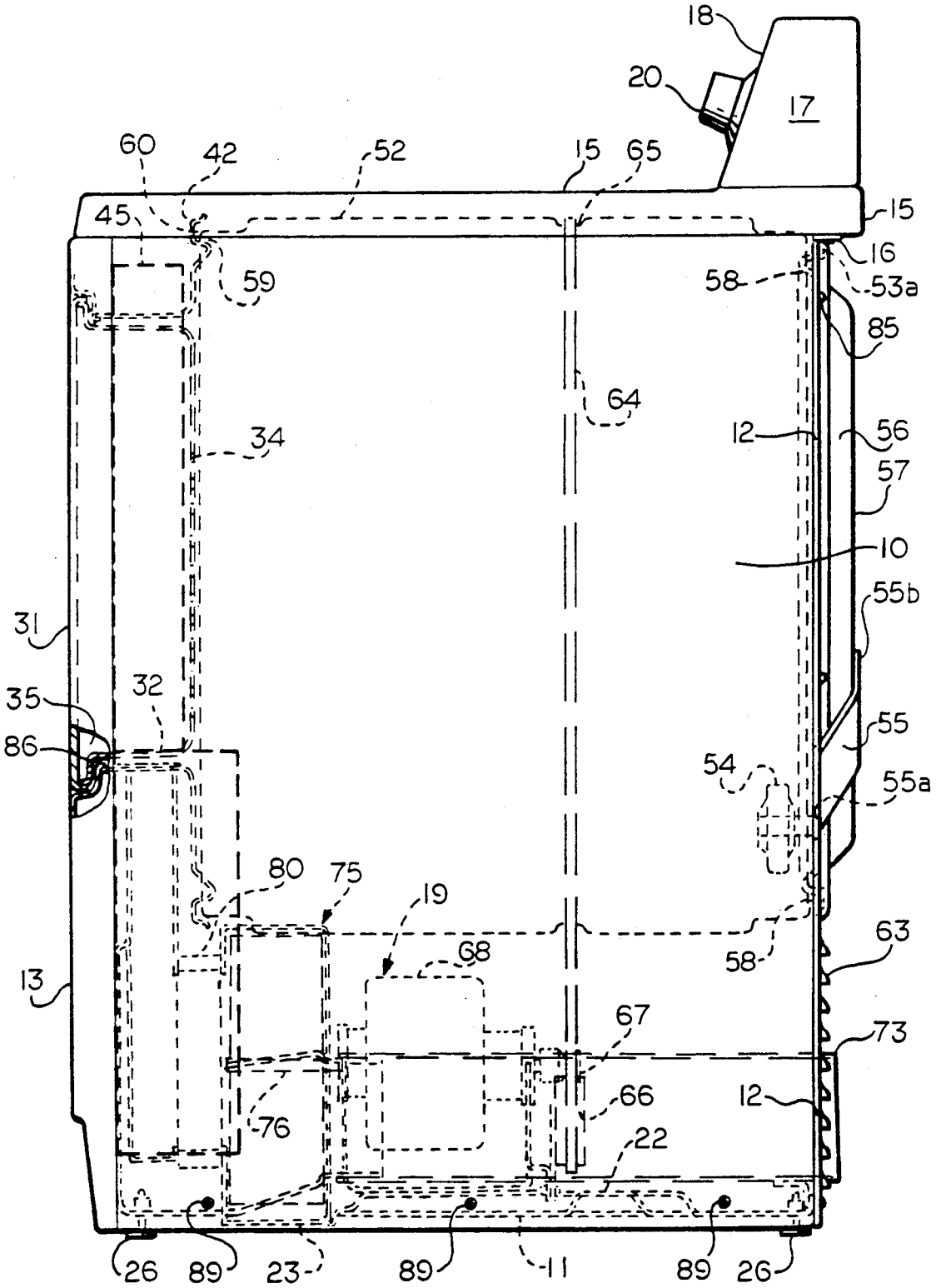
FIG. 2 is a right side elevational view of the dryer of FIG. 1.
Figure 3:
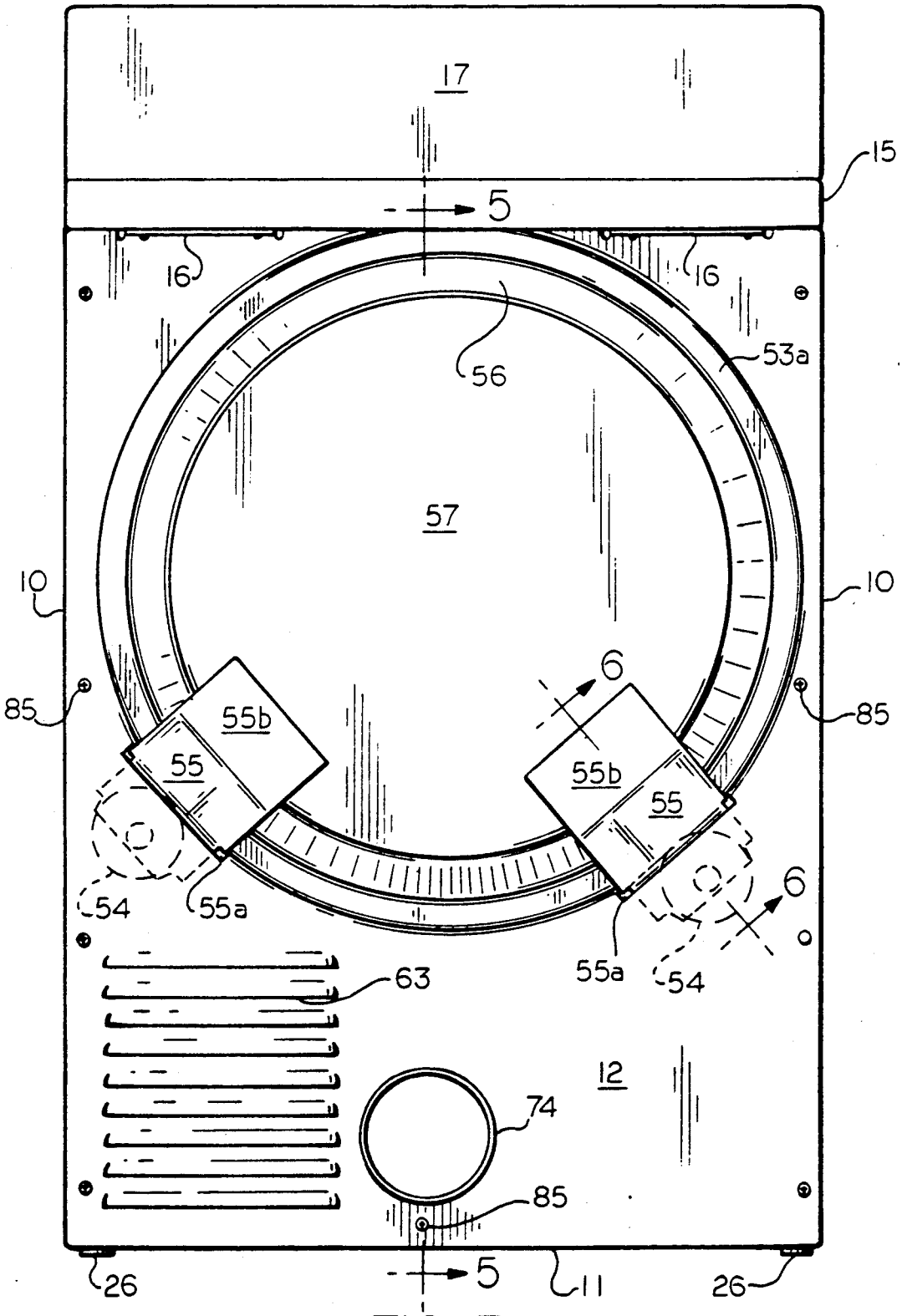
FIG. 3 is a rear elevational view of the dryer of FIG. 1.

Referring to FIGS. 1-3, the clothes dryer is contained within a cabinet comprised of opposite side panels 10, a bottom panel 11, a rear panel 12 and a front panel 13. The side panels 10, in this embodiment, are separate from the bottom panel 11. The side panels 10 include flanges **10*a* and 10*b* at the front and rear edges. The side panels 10 are secured to the bottom panel 11 by a plurality of fasteners 89 (see FIG. 4, 4A). Alternatively, the side panels 10 could be formed integral with the bottom panel 11 and the sides upturned in the form of a U-shaped piece The top panel 15 of the cabinet is attached to the front panel 13 at detents and clips on the underside thereof (not shown), and is secured to the top margin of the rear panel 12 at out-turned integral brackets 16. The top panel 15 includes a raised housing 17 for the dryer controls (not shown) that are operated along the sloped front surface 18, such as by a knob 20 and selector buttons 21. The controls are well known and take various forms. Their placement in the housing 17** is in the well known manner and do not constitute a novel aspect of the invention.

Figure 4:
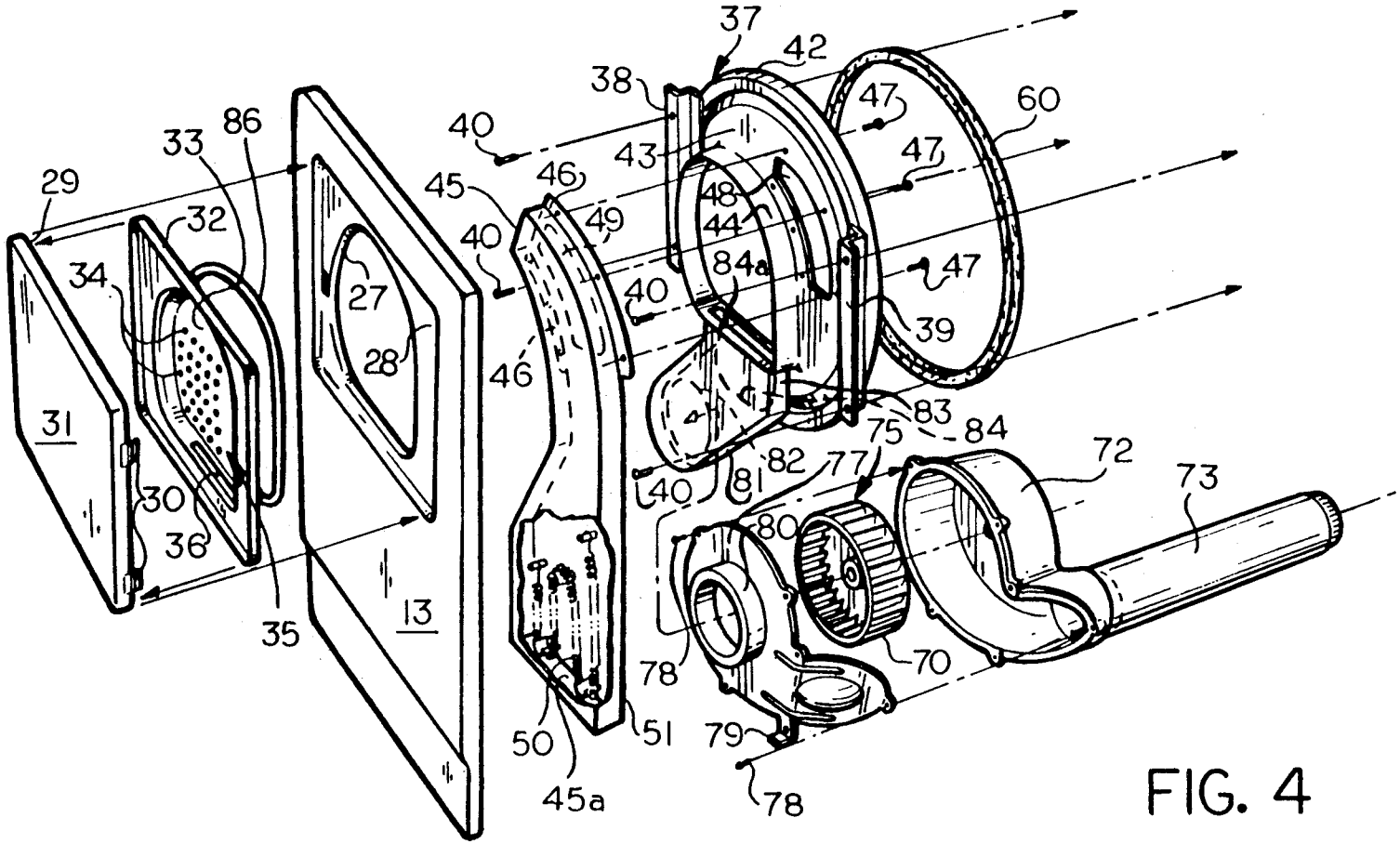
FIG. 4 is a partial exploded view in perspective of the elements at the front of the dryer.
Figure 4A:
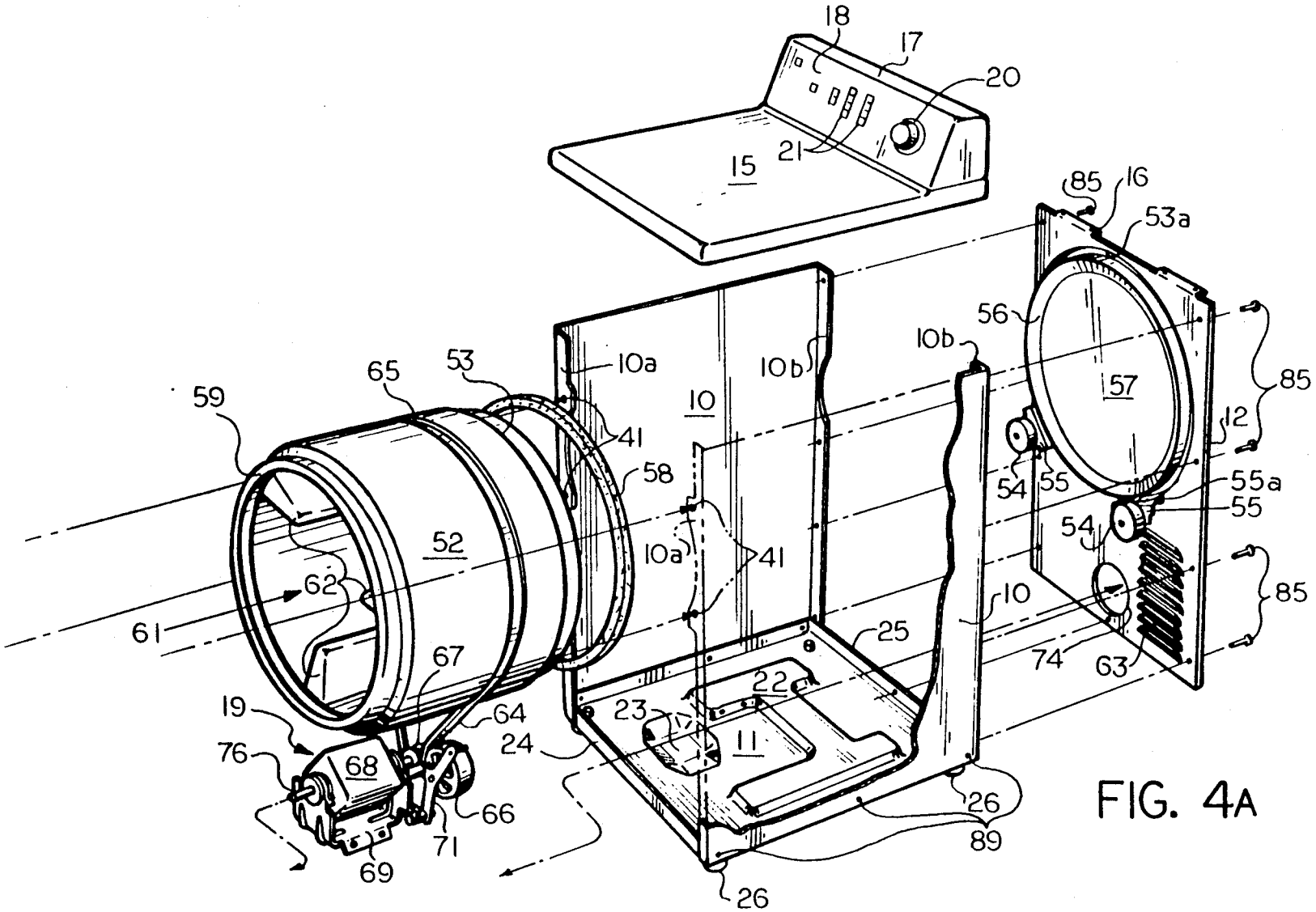
FIG. 4A is a partial exploded view in perspective that is a companion to FIG. 4 showing the elements at the rear of the dryer and exploded from the dryer cabinet.

As may be seen on FIG. 4A, side panels 10 extend vertically from bottom panel 11 at its lower edges. The bottom panel 11 is stamped sheet metal and includes a raised island portion 22 for mounting a motor assembly 19 and a depressed portion or well 23 for receiving a portion of a blower assembly 75, as hereinafter described. The front and rear edges of bottom panel 11 have vertical flanges 24 and 25. The side panels 10 each have the front and rear in-turned flanges **10*a* and 10*b* for fastening the front panel 13 and rear panel 12. The bottom panel 11 further includes a plurality of adjustable feet 26** threaded at the corners for supporting the dryer on a floor and for leveling the dryer.

As best shown in FIG. 4, the front panel 13 has an access opening 27 formed in a recessed area 28. An access door 29 is hinged at 30 on the front panel 13 to swing between open and closed positions relative to the access opening 27. The access door 29 includes an outer panel 31 that is flush with the front panel 13 when the access door 29 is closed, and an inner panel 32 having an inwardly projecting portion 33 that extends through the access opening 27 and matches the contour of the opening 27. As shown in FIGS. 1, 2 and 4, a seal 86 extends around the inwardly projecting portion 33 of the inner panel 32 for engagement with the recessed area 28 of the front panel 13 around the access opening 27 to effectively provide an air seal at the access opening 27. The surface of the inwardly projecting portion 33 of the inner panel 32 is provided with a series of inlet apertures 34 connecting the interior of the dryer to a space 35, shown in FIGS. 2 and 4, that is between the inwardly projecting portion 33 of the access door 29 and the inside surface of its outer panel 31. The space 35 is connected at the lower inwardly directed wall of inner panel 32 through an elongated slot 36, as shown in FIG. 4, to exhaust air from the space 35.

A front bulkhead 37 is provided within the cabinet and is fastened at its vertical ribs 38 and 39 by four bolts 40 that extend through matching holes 41 of the in-turned flanges 10*a* at the front sides of the two side panels 10 (see FIGS. 4 and 4A). Bulkhead 37 has an outer flange 42 integrally formed on a circular central portion 43. The vertical ribs 38 and 39 are welded onto the circular central portion 43. The flange 42 defines an annular U-shaped cavity or recess opening rearwardly on the bulkhead 37. Bulkhead 37 also includes a forwardly projecting flange 44 defining a passageway that is formed from the central portion 43 and is shaped to fit around the inwardly projecting portion 33 of the door inner panel 32.

A duct assembly 45 has wing portions 46 extending laterally outwardly from its upper arcuate reach. The wing portions 46 are fastened to the circular central portion 43 of the bulkhead 37 by sheet metal fasteners 47 that are disposed on either side of an arcuate opening 48 in the central portion 43. Duct 45 is closed at its upper end and a port 49 is formed through the innermost wall of the duct 45. The port 49 substantially corresponds with the opening 48 through the bulkhead's circular central portion 43. To accommodate the duct 45, the passageway defined by flange 44 is situated off center of the bulkhead 37. With the duct 45 fastened to the bulkhead 37, front panel 13 is attached to the sides 10 to enclose the duct 45 inside the front panel 13, and the flange 44 of the bulkhead 37 extends forwardly under duct 45 to match the access opening 27. The access door 29, when closed, has its inwardly projecting portion 33 of the inner door panel 32 sealed around the access opening 27 and the flange 44 of the bulkhead 37 by the seal 86.

Atmospheric air is brought into a open lower end 45*a* of a lower portion 51 of the duct 45 for heating. The air to be heated is conducted through the duct 45 past a heater 50 supported in a lower portion 51 of the duct 45. Heated air is circulated to the arcuate upper portion of the duct 45 and through the port 49 into a drum 52 of the dryer, as will be presently described.

The drum 52 is formed with a cylindrical wall from sheet metal. (See FIGS. 2 and 4A.) Drum 52 is supported in the dryer to rotate about its longitudinal, central axis, and provides the tumbler of the dryer. Drum 52 has a circular bearing surface 53 at its back edge which rides on rollers 54. In this embodiment, and as best illustrated on FIGS. 3, 4A, 5 and 6, two rollers 54 are rotatably supported on brackets 55 that are offset, the free end portion 55*b* of each bracket 55 extending through slots 55*a* on the rear panel 12 just outside an annular U-shaped portion 53*a* thereof. The brackets 55 are welded to the outside of rear panel 12 on a rearwardly projecting circular portion 57 of the rear panel 12. It is also anticipated that various other methods of roller mounting may be utilized such as other bracket configurations and supports formed directly from the sheet metal of the rear panel 12.

Figure 5:
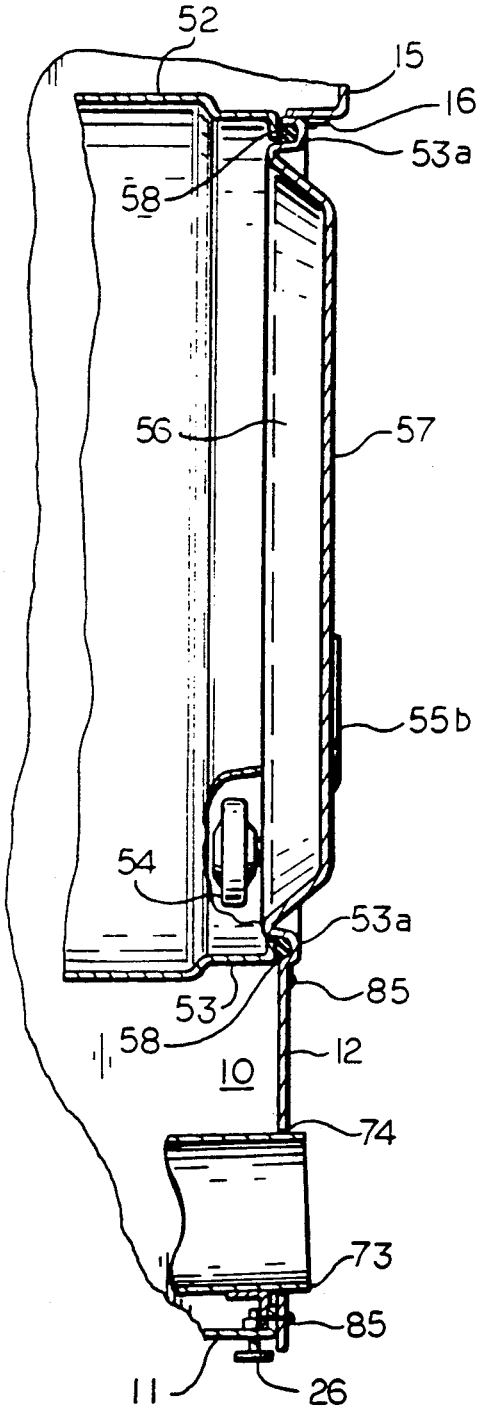
FIG. 5 is a sectional view taken along line 5—5 on FIG. 3.
Figure 6:
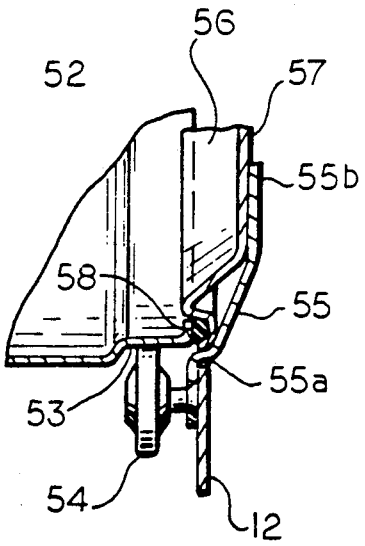
FIG. 6. is a sectional view taken along line 6—6 on FIG. 3.

The rear panel 12 is a sheet stamping of steel that includes the annular, U-shaped portion or recess 53*a*. The U-shaped portion 53*a* retains a gasket or seal 58 on which the rear facing portion of the bearing surface 53 engages to form an air seal at the rear end of the drum 52 on the rear panel 12 of the dryer. Radially inwardly of the U-shaped portion 53*a* is an annular outwardly extending web portion 56 integral with the center circular portion 57, a construction feature which places the plane of the circular portion 57 rearwardly of the plane of the rear panel 12. The circular portion, 57 can be varied in forming to provide for predetermined variations in dryer capacity. For example, the circular portion 57 and the annular U-shaped portion 53*a* can both be spaced rearward from the plane of the rear panel 12 and combined with an axially longer drum 52 to increase capacity. Conversely, the annular U-shaped portion 53*a* and circular portion 57 can be formed forwardly and combined with an axially shorter drum 52 to decrease capacity. The brackets 55 each extend through slot 55*a* in the rear panel 12 and are bent to conform to the outside surface of the portions 56, 57. The free end portion 55*b* of each bracket 55 is disposed along the outside of the rear panel 12 and is there welded to the steel stamping (FIG. 5).

The U-shaped portion 53*a* of the stamping holds the circular gasket or seal 58 which bears against the end of the drum 52 at the annular in-turned portion thereof. (See FIG. 5.) The gasket or seal 58 seals the rear end of the drum 52 on the rear panel 12 of the dryer and the rollers 54 support the drum 52 thereat for rotation.

The forward end of drum 52 has a circular bearing surface 59 that is inturned at the axial edge and this end surface 59 bears against a circular gasket or seal 60 that is held in the circular flange 42 of the front bulkhead 37. Circular flange 42 is U-shaped in crops section. The forward end of drum 52 rotates on the gasket or seal 60 supported in the front bulkhead 37.

The drum 52 defines a cylindrical fabric drying chamber 61. The inside wall of the drying chamber 61 is provided with a plurality of annularly spaced apart, axially extending baffles 62 fixed on the inside of the drum 52. Baffles 62 extend radially into drying chamber 61 for assisting in movement of fabrics within the drying chamber 61 during rotation of drum 52. Air is admitted into the cabinet through fixed louvers 63 formed in the lower section of the rear panel 12. This air is drawn into the lower section 51 of the duct assembly 45 through the open end 45*a*.

The drum 52 is rotated about its central longitudinal axis by a belt 64 that is reeved to run in an annular groove 65 on the exterior wall of the drum 52, then over an idler pulley 66 and around a drive pulley 67. An electric drive motor 68 is supported by a motor mount 69 bolted onto the raised island portion 22 of the bottom wall 11 stamping of the cabinet. The rear facing end of output shaft 76 of the motor 68 has the drive pulley 67 keyed thereon and the idler pulley 66 is rotatably mounted on the bracket 71 of the motor mount 69.

Air is circulated in the dryer by a blower assembly 75 supported in the lower left forward section of the cabinet. The blower assembly 75 comprises a housing 72 with an exhaust pipe 73 connected thereto. The pipe 73 extends rearwardly and is held in a circular opening 74 that is cut out of the cabinet's rear panel 12. An impeller 70 of the blower assembly 75 is keyed on the front facing end of the shaft 76 of the motor 68, and the blower housing 72 is positioned at the well 23 along the bottom panel 11 of the cabinet. A cover 77 of the housing 72 is fastened by screws 78. The blower assembly 75 is fastened to the bottom panel 11 at a foot bracket 79 by suitable means.

A circular bushing 80 at the front of the housing cover 77 forms a hollow passageway and fits snugly in a lower duct assembly 81 at a circular port 82 thereof. The bushing 80 forms a substantially airtight connection to the duct assembly 81 at its lower section which is offset and towards the left of the cabinet. An upper reach 83 of the duct assembly 81 is generally vertical and is integrally connected on the flange 44 of the front bulkhead 37 which communicates with the drum 52 through a rectangular slot opening 84*a* formed at the lower horizontal flat section of the flange 44.

A lint filter 84 (see FIG. 1) is positioned in the upper reach 83 of the duct assembly 81 and is across the path of air flowing to the duct assembly 81. This slot opening 84*a* of the lint filter 84 aligns with and matches the slot 36 of the inner panel 32 of the access door 29 when the latter is closed. The top of the lint filter 84 conforms to the straight portion of the flange 44 (FIGS. 1 and 4) and has access for cleaning. The lint filter 84 is comprised of a polypropylene frame holding a dacron cloth filter screen. The lint filter 84 extends downwardly through the rectangular slot opening 84*a* in flange 44 and is contoured to rest on the flange 44. The air flow from the drying chamber 61 must flow through the filter 84 and past the filter screen thereof to enter the duct assembly 81. With the access door 29 closed, the inner panel 32 fits within the flange 44 of the bulkhead 37 and the slot 36 of the panel 32 aligns with the filter opening 84*a*. Air from inside the drying chamber 61 passes through the outlet apertures 34 and through the slot 36.

The rear panel 12 of the dryer cabinet is fastened to the back corners of the side panels 10 by sheet metal fasteners 85 which engage the side flanges 10*b*.

With the dryer assembled as described, the blower impeller 70 is rotated in a manner so as to be operated as a suction system by the motor 68. Air is drawn into the lower portion 51 of the duct 45 through the opening 45*a* (FIG. 1) and is heated by heater means 50, which may be either electric heater coils (as illustrated) or a gas burner means. The heated air is conveyed through the duct assembly 45 to the inside of the drum 52 through the opening 48 in the front bulkhead 37. Moisture laden air is removed from drum 52 through outlet apertures 34 of the inner panel 32 of the access door 29 which protrudes into the drum 52, and into the space 35 formed between the access door 29 and its inner panel 32. This air is exhausted through the slot 36 in the inner door panel 32, into the top opening of the lint filter 84 wherein particles of lint and foreign material are trapped and held by the screen, and filtered exhaust air passes into the lower duct assembly 81. Air exits from the duct assembly 81 at the port 82 and into the blower assembly 75 from which it is exhausted through the exhaust pipe 73 and the opening 74 in the rear panel 12. The motor 68 also drives the drum 52 of the dryer by the belt 64 to rotate the drum 52 on its end supports at the rollers 54 and the bulkhead support in flange 42, as previously described.

In the construction of the dryer described above, the inlet duct for air is mounted to the front bulkhead and is covered from view by the front panel of the dryer. The duct parts may be made inexpensively without finishing, e.g., from sheet metal or plastic. The inlet duct is arcuate in its upper reaches such that it wraps around the door access opening at the front of the dryer. The access door includes the inner door with outlet grid apertures for the air coming from the drying chamber. The inner door is shaped to protrude slightly into the drying chamber, and in so doing, seals the access opening at the front bulkhead, plus achieves the desired movement of the clothing in the drying chamber toward the air inlet but keeps the clothing free from the air inlet opening.

The lint screen may be constructed of a plastic frame and dacron screen of a mesh to hold lint and foreign particles as the exhaust air passes from the drying chamber. As illustrated, the lint screen is not shown as being readily removable by the user, however, a removable screen unit with handle may be easily adapted.

The outlet passage for exhaust air includes the grid of apertures in the inner door panel which connects to an outlet slot that registers with the lint filter when the access door is closed.

The drum is comprised of a hollow cylindrical wall supported at its ends for rotation and is closed and sealed at its rear end by the stamped sheet metal formation on the single rear panel of the dryer cabinet. The front end of the drum is sealed annularly and rotatably supported on the front bulkhead. Air is introduced into the cabinet, is heated, and circulated through a duct work at the front of the drum, and moisture laden exhaust air is removed from the front of the drum and into the inner door member through apertures, thence into the exhaust duct connected through the power driven blower to the rear exhaust port. The drum seals against the surface of the front bulkhead and the single rear cabinet panel both being equipped with a gasket or other seal means.

By this construction, the rear bulkhead of the dryer is eliminated which enables lengthening the drum for a dryer cabinet of standard dimensions, thereby enlarging the capacity of the dryer. There has been described herein a clothes dryer having a unique air flow and tumbler support.

A feature of the instant invention is that the volumetric capacity of the dryer can be varied by changing the rear panel and the drum. For example, to increase capacity the rear panel would be changed for one having a deeper web portion and a corresponding longer drum would be used. It follows that to decrease capacity the rear panel would be changed for one with a shallower web portion and a shorter drum would be used.

In the drawings and specification, there has been set forth a preferred embodiment of the invention, and although specific terms are employed, these are used in a generic and descriptive sense only and not for purposes of limitation. Changes in the form and proportion of the parts, as well as substitution or equivalents, are contemplated as circumstances may suggest or render expedient without departing from the spirit or scope of the invention as such is defined in the following claims.

I claim:

1. A clothes drying apparatus comprising:

a cabinet having side, bottom, top, rear and front panels, said rear panel including a formed section with an inwardly facing first surface and an outwardly facing second surface;

a bulkhead within said cabinet adjacent said front panel;

a cylinder wall having open ends and a generally horizontal axis and front and rear annular seal surfaces juxtaposed to said bulkhead and said rear panel respectively;

said first surface of said rear panel formed section having a circular portion facing said rear annular seal surface, said circular portion generally corresponding to and aligned with said rear annular seal surface;

said bulkhead having a circular portion generally corresponding to and aligned with said rear annular seal surface;

said bulkhead having a circular portion generally corresponding to and aligned with said front annular seal surface;

said cylinder wall, said rear panel circular portion and said bulkhead circular portion defining a clothes drying chamber;

first and second seal means engaging said circular portions of said rear panel and said bulkhead and the respective generally mating annular seal surfaces at the rear and front of said cylinder wall;

means supporting said cylinder wall for rotation about said horizontal axis;

means for rotating said cylinder wall; and means for introducing heated air into and removing moisture laden air from said drying chamber.

2. The apparatus of claim 1 wherein said cylinder wall and said rear panel are formed to provide a predetermined drying chamber capacity.

3. The apparatus of claim 1 wherein said rear panel is a unitary metal stamping, said circular portion of said rear panel comprising an annular recess and a central portion circumscribed by said annular recess, and wherein said first seal means comprises a seal retained in said annular recess.

4. The apparatus of claim 3 wherein said circular portion of said bulkhead comprises an annular recess, and wherein said second seal means comprises a seal retained in said annular recess.

5. The apparatus of claim 3 and further comprising:

a pair of spaced rollers rotatably mounted on said central portion of said rear panel and operable for supporting said cylinder wall.

6. The apparatus of claim 5 and further comprising:

bracket means securely attached to said central portion of said rear panel;

each of said pair of rollers being rotatably mounted on said bracket means for free rotation.

7. The apparatus of claim 3 wherein said central portion comprises a plane closely adjacent and generally parallel to the plane of said rear panel.

8. A clothes drying apparatus comprising:

a cabinet having side, bottom, top, rear and front panels, said rear panel including a formed section with an inwardly facing first surface and an outwardly facing second surface;

a bulkhead within said cabinet adjacent said front panel;

a cylinder wall having open ends and a generally horizontal axis and front and rear annular seal surfaces juxtaposed to said bulkhead and said rear panel respectively;

said first surface of said rear panel formed section having a circular portion facing said rear annular seal surface, said circular portion generally corresponding to and aligned with said rear annular seal surface;

said bulkhead having a circular portion generally corresponding to and aligned with said front annular seal surface;

said cylinder wall, said rear panel circular portion and said bulkhead circular portion defining a clothes drying chamber;

first and second seal means engaging said circular portions of said rear panel and said bulkhead and the respective generally mating annular seal surfaces at the rear and front of said cylinder wall;

means supporting said cylinder wall for rotation about said horizontal axis;

means for rotating said cylinder wall;

means for introducing heated air through said bulkhead into said drying chamber; and means for removing moisture laden air from said drying chamber through said bulkhead.

9. The apparatus of claim 8 wherein said cylinder wall and said rear panel are formed to provide a predetermined drying chamber capacity.

10. The apparatus of claim 8 wherein the cabinet front panel includes an access opening and is disposed in front of the bulkhead, and further comprising:

door means hinged on the front panel for closing and opening said access opening;

said bulkhead having a passageway communicating with the access opening of said front panel;

said means for introducing heated air to said drying chamber being spaced from said passageway; and said means for removing moisture laden air from said drying chamber being connected to said passageway.

11. The apparatus of claim 8 wherein said means for introducing heated air to said drying chamber comprises:

an aperture in said bulkhead;

a first duct work having upper and lower portions, the upper portion being connected to said bulkhead for conducting air through said aperture thereof, the lower portion having means for receiving air; and heater means in the lower portion of said first duct work for heating air received therein.

12. The apparatus of claim 10 wherein said means for removing moisture laden air from the drying chamber comprises:

a second duct work connected to said passageway in said bulkhead;

a blower assembly connected to said second duct work;

and means for driving the blower assembly to remove said air from said drying chamber through said second duct work.

13. The apparatus of claim 12 and further comprising:

a filter means in said second duct work for removing foreign particles from air flowing through said second duct work.

14. The apparatus of claim 10 wherein said door means comprises an outer panel and an inner panel, said inner panel having a rearwardly projecting portion spaced from said outer panel and defining a space therebetween, said projecting portion of said inner panel corresponding with said passageway of said bulkhead and protruding therethrough into said drying chamber, said means for removing moisture laden air from said drying chamber comprising:

a series of apertures through said inner panel connecting said drying chamber with said space when said door means is closed;

duct work for conveying air; and a slot in said inner panel connecting said space to said duct work.

15. The apparatus of claim 14 wherein said bulkhead passageway includes a flange having a slot opening registerable with said slot in said in inner panel, said duct work being connected to convey air from said drying chamber through said first and second mentioned slot openings when the latter are in registry.

16. A clothes drying apparatus comprising:

a cabinet having side, bottom, top, rear and front panels, said rear panel including a formed section with an inwardly facing first surface and an outwardly facing second surface;

a bulkhead within said cabinet adjacent said front panel and having a passageway into said drying chamber;

a cylinder wall having open ends and a generally horizontal axis and front and rear annular seal surfaces juxtaposed to said bulkhead and said rear panel respectively;

said first surface of said rear panel formed section comprising a unitary metal stamping having a portion facing said rear annular seal surface, said portion corresponding generally to and aligned with said rear annular seal surface;

said bulkhead having a portion corresponding generally to and aligned with said front annular seal surface;

said cylinder wall, said rear panel portion and said bulkhead portion defining a clothes drying chamber;

first and second seal means engaging said portions of said rear panel and bulkhead;

means supporting said cylinder wall for rotation about said horizontal axis;

means for rotating said cylinder wall;

air inlet means including duct work with an outlet connected to said bulkhead adjacent said passageway for introducing heated air into said drying chamber; and air outlet means including duct work with an inlet connected to said passageway for removing moisture laden air from said drying chamber.

17. The apparatus of claim 16 wherein said rear panel includes a circular central portion closely adjacent and generally parallel to the plane of said rear panel.

* * * * *